US005468412A

United States Patent [19]

Rodzewich

[11] Patent Number: 5,468,412

[45] Date of Patent: Nov. 21, 1995

[54] LOW FOAMING AQUEOUS CLEANING AND PASSIVATING TREATMENT FOR METALS

[75] Inventor: Edward A. Rodzewich, Flourtown, Pa.

[73] Assignee: Betz Laboratories, Inc., Trevose, Pa.

[21] Appl. No.: 306,041

[22] Filed: Sep. 14, 1994

Related U.S. Application Data

[63] Continuation-in-part of Ser. No. 107,382, Aug. 16, 1993, abandoned.

[51] Int. Cl.[6] ..... C11D 3/48; C11D 3/30

[52] U.S. Cl. ..... 252/106; 252/142; 252/173; 252/174.21; 252/525; 252/527; 252/544

[58] Field of Search ..... 252/106, 525, 252/527, 173, 142, 174.21, 544

[56] References Cited

U.S. PATENT DOCUMENTS

| | | | |
|---|---|---|---|
| 3,374,171 | 3/1968 | Davis | 252/34.7 |
| 4,113,498 | 9/1978 | Rones et al. | 106/14.13 |
| 4,540,442 | 9/1985 | Smith et al. | 134/2 |
| 4,578,208 | 3/1986 | Geke et al. | 252/135 |

*Primary Examiner*—Paul Lieberman
*Assistant Examiner*—Lorna M. Douyon
*Attorney, Agent, or Firm*—Alexander D. Ricci; Steven D. Boyd

[57] ABSTRACT

A cleaning and passivation treatment for metal surfaces which is essentially phosphate free and resistant to foaming in soft water is disclosed. The treatment solution includes relatively water insoluble surfactants without the use of conventional hydrotropes. The treatment solution includes an aqueous solution of monoethanolamine, boric acid, a non-ionic surfactant having a cloud point below about 25° C. and a hydrotropic coupling agent preferably a combination of caprylic acid and capric acid.

4 Claims, No Drawings

LOW FOAMING AQUEOUS CLEANING AND PASSIVATING TREATMENT FOR METALS

This application is a continuation-in-part of application Ser. No. 08/107,382 filed Aug. 16, 1993.

FIELD OF THE INVENTION

The present invention relates to cleaning and passivating treatments for metals. More particularly, the present invention relates to cleaning and passivating treatments for metals which are essentially phosphate free and resistant to foaming when used in soft water systems. The aqueous treatments of the present invention are stable formulations which include relatively water insoluble surfactants which are solubilized by a unique combination of carboxylic acids.

BACKGROUND OF THE INVENTION

Emulsion type cleaners are employed in the metal treatment industry to clean and passivate a metal surface. These types of cleaners are typically oil based and in the form of a macroemulsion in water. This type of cleaner is typically used to remove gross soil contaminants, fines, and cooling lubricants from machined metal surfaces. The cleaned metal surfaces do not become "water break free" clean in the traditional sense. This type of "cleaner" leaves an oily film on the surface that provides rust protection.

Emulsion cleaners and clean and passivate treatments can sometimes be interchangeable. Emulsion cleaners usually provide longer term passivation. Clean and passivate cleaners are typically employed in applications which require good cleaning and temporary metal passivation. Treated parts may need to remain rust free, while exposed in the manufacturing plant for from several hours up to 30 days. In order to maintain the rust prevention ability, these cleaners are not rinsed. Commercial clean and passivate treatments may be composed of a variety of alkaline builders and surfactants. They also typically contain passivating components, for example: nitrites, amines, and anionic surfactants. Passivation is achieved by formation of a passive iron oxide or barrier film on the metal surface.

Typically, clean and passivate treatments contain low foaming anionic surfactants such as phosphate esters because they are soluble in alkaline solutions. Such surfactants are susceptible to foaming in soft water or deionized (DI) water. Further, they can interact with the soils being removed such as metal working coolants to enhance the foaming. The presence of phosphate in these surfactants gives rise to environmental concerns regarding waste discharge.

In practice, a clean and passivate treatment is exposed to a variety of coolants and lubricants used in machining the metal surface to be treated. Also, a clean and passivate treatment may be employed in different areas where the hardness of the water varies widely. It was discovered that a clean and passivate treatment made up of monoethanolamine and an anionic phosphate ester surfactant (Permatreat 435 available from Betz Laboratories, Inc.), was susceptible to foaming in applications where soft water was used. The foaming problem was most pronounced in systems where Cimtech 400 coolant, a synthetic metal working coolant containing alkanolamine available from Cincinnati Millicron, was employed.

SUMMARY OF THE INVENTION

It was discovered that an essentially phosphate free clean and passivate treatment resistant to foaming in soft water could be formulated. The clean and passivate treatment of the present invention is resistant to foaming in soft water applications and in applications where coolants containing alkanolamine are present while providing commendable passivation properties based upon the conventional cast iron chip test. The aqueous clean and passivate formulation of the present invention employs relatively water insoluble surfactants without the use of conventional hydrotropes. The clean and passivate formulation of the present invention comprises a stable, aqueous solution of monoethanolamine, boric acid, a nonionic surfactant having a low (near or below 25° C.) cloud point, a caprylic acid/capric acid hydrotropic agent, and optionally a biocidal agent. The surfactant of the present invention is essentially water insoluble. It was found that the caprylic acid/capric acid combination provided a stable solution of the water insoluble surfactant, in the presence of monoethanol amine.

DESCRIPTION OF THE PREFERRED EMBODIMENTS

The present inventor discovered a stable clean and passivate treatment formulation for use in soft water systems, which is resistant to foam formation and is essentially phosphate free. The clean and passivate formulation of the present invention is an aqueous solution of monoethanolamine; boric acid; a nonionic surfactant having a cloud point below about 25° C.; a caprylic acid/capric acid hydrotropic agent; and optionally sodium omadine as a biocidal agent.

The clean and passivate formulation of the present invention is typically supplied as a concentrate to be diluted with water prior to use. The formulation of the present invention may be diluted with soft water without risk of foam formation during use. Also, the formulation of the present invention exhibits good concentrate stability.

The formulation of the present invention employs a nonionic surfactant having a low (below about 25° C.) cloud point. Such surfactants, while soluble in dilute aqueous baths are unstable in concentrated liquid solutions (essentially water insoluble). Such low cloud point surfactants were found to show a limited responsiveness to the solubilizing effects of conventional hydrotropic coupling agents such as sodium xylene sulfonate and isononanoic acid in concentrated solution of the present invention. It is believed that the limited responsiveness was a result of the monoethanolamine concentration in the formulation of the present invention. The present inventor found that the hydrotropic coupling agent, comprising a combination of caprylic acid and capric acid was effective at solubilizing the surfactants of the present invention in concentrated solutions. The stability of the formulation in concentrate form is important in order to allow economical shipping and handling of the treatment solution. It was discovered that a mixture of caprylic acid and capric acid was an effective hydrotrope in concentrated solutions at both room temperature and at elevated temperatures. Thus, the clean and passivate treatment of the present invention is able to replace a soluble phosphate component with an insoluble surfactant due to the unique effects of the caprylic acid/capric acid hydrotropic agent.

The preferred clean and passivate formulation of the present invention comprises an aqueous solution of from 10 to 30% preferably about 20% monoethanolamine; from 2 to 10% preferably about 5.0% boric acid; from 0.2 to 1.0% preferably about 0.5% a nonionic low cloud point surfactant; and from 2.0 to 10.0% preferably about 3.5% of a 6 to 1 ratio of caprylic acid to capric acid. Optionally a biocidal agent such as sodium omadine may be added in concentrations of up to about 0.2%.

The preferred nonionic, low cloud point surfactant of the present invention is a propylene oxide-ethylene oxide-propylene oxide block copolymer available under the trademark Pluronic 31 R1 from BASF Corporation. The preferred low cloud point surfactants of the present invention are SARA 313 free materials. The use of such materials is in demand commercially in order to avoid regulatory, handling and discharge complications. Other nonionic, low cloud point surfactants which exhibit similar foam limiting capabilities include Tergitol TMN3 and Tetronic 1501. Tergitol TMN3 is an ethoxylated trimethylnonanol available from Union Carbide and Tetronic 1501 is a block copolymer of ethylene oxide and propyleneoxide addition to ethylene diamine from BASF Corporation. These nonionic low cloud point surfactants, while effective at controlling foam, are insoluble in water so stable aqueous formulations require an effective hydrotropic agent. Conventional hydrotropic agents were found to be ineffective. The present inventor discovered that a blend of caprylic acid and capric acid in a ratio of about 6 to 1 was effective at solubilizing the combination, allowing a stable mixture.

A 2% dilution in deionized water of the clean and passivate solution of the present invention was prepared and contaminated with 500 ppm of an alkanolamine contain metal working coolant (Cimtech 400 available from Cincinnati Millicron). This clean and passivation solution produced a clean and passivated surface in a spray washer cabinet when applied to machined metal surfaces. No foam formed in the spray washer cabinet. Chip tests were conducted to compare the rust protection efficacy of the present invention to commercial clean and passivate products. In the chip test, 2.5 grams of the test formulation was placed in 100 grams of water. Five grams of cast iron chips were placed on a piece of Whatman #1 filter paper in a weighing dish. 50 milliliters of the test solution was poured onto the chips. After 30 minutes, the solution was poured off. The chips were rated (rust spots counted) after 24 hours exposure in the laboratory. The formulation of the present invention provided comparable chip rust protection to two commercial clean and passivate formulations, Cimtech 411 available from Cincinnati Millicron and Castrol 3601 available from Castrol.

The effectiveness of the composition and method of the present invention is demonstrated by the following example. Corrosion protection and foaming tests were conducted with a prior art clean and passivate treatment and a clean and passivate treatment in accordance with the present invention. Table I summarizes the makeup of each treatment. The corrosion protection test was performed with ASTM D4627-86 cast iron chips. The test procedure is as described above, with no metal working coolant contamination.

TABLE I

| | Test Solutions (% wt/wt) | |
|---|---|---|
| | Prior Art | Present Invention |
| Water | 73.8 | 70.8 |
| Ethanolamine | 20.0 | 20.0 |
| Boric Acid | 5.0 | 5.0 |
| Tergitol TMN3 | — | 0.5 |
| Caprylic Acid | — | 3.0 |
| Capric Acid | — | 0.5 |
| Surmax CS 521* | 1.0 | — |

TABLE I-continued

| | Test Solutions (% wt/wt) | |
|---|---|---|
| | Prior Art | Present Invention |
| Sodium Omadine, 40% | 0.2 | 0.2 |

*Surmax CS 521 is an anionic phosphate ester available from Chemax Inc.

EXAMPLE 1

Test solutions were prepared in dilutions from 0 to 3% in ½% increments. The test dilutions were aged for 24 hours and then the chip tests described above performed. The tests showed that a 3% dilution of the prior art solution was needed to provide 100% chip protection while a 2% dilution of the present invention provided 100% chip protection. Thus, the present invention not only provides a phosphate free clean and passivate formulation, but also provides one which is more effective.

EXAMPLE 2

Various ratios of caprylic acid to capric acid were tested to determine their effect on the stability of the cleaning and passivating treatment solution. Table II summarizes the formulations tested and their efficacy at chip protection (as tested by the procedure described above) as well as stability.

TABLE II

| | Test Solutions (% wt/wt) | | | | | | | |
|---|---|---|---|---|---|---|---|---|
| | 1 | 2 | 3 | 4 | 5 | 6 | 7 | 8 |
| Water | 72.3 | 70.8 | 72.3 | 70.8 | 70.8 | 68.8 | 70.8 | 70.8 |
| Ethanolamine | 20.0 | 20.0 | 20.0 | 20.0 | 20.0 | 20.0 | 20.0 | 20.0 |
| Boric acid | 5.0 | 5.0 | 5.0 | 5.0 | 5.0 | 5.0 | 5.0 | 5.0 |
| Caprylic acid | 2.0 | 3.5 | — | 3.0 | 2.0 | 2.0 | 2.0 | 3.0 |
| Capric acid | — | — | 2.0 | 0.5 | 1.5 | — | 0.5 | — |
| Nonanoic acid | — | — | — | — | — | 3.5 | 3.0 | 0.5 |
| Tergitol TMN3 | 0.5 | 0.5 | 0.5 | 0.5 | 0.5 | 0.5 | 0.5 | 0.5 |
| Sodium Omadine, 40% | 0.2 | 0.2 | 0.2 | 0.2 | 0.2 | 0.2 | 0.2 | 0.2 |
| Chip protection | NR | NR | NR | NR | NR | NR | NR | NR |
| Stability (30 days @) | | | | | | | | |
| 40° F. | floc | floc | floc | clear | floc | insol. | insol | clear |
| 120° F. | clear | clear | clear | clear | clear | insol. | insol. | clear |
| 70° F. | clear | clear | clear | clear | clear | insol. | insol. | clear |

NR = no rusting

As seen in Table II only the 6 to 1 ratio of caprylic acid to capric acid (Formula 4) was able to provide low and high temperature stability for this formulation. Formula 6 shows that if caprylic acid is not used, the low cloud point surfactant cannot be solubilized. Formula 7 shows that when the ratio is reversed, the low cloud point surfactant cannot be solubilized. Formula 8 shows that a combination of caprylic acid and a C9 fatty acid (nonanoic acid) is effective in the 6 to 1 ratio.

While the present invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

I claim:

1. A cleaning and passivating treatment solution for metal surfaces for use in soft water, which is resistant to foaming, comprising an essentially phosphate free aqueous solution of from 10 to 30% wt. monoethanolamine, from 2 to 10% wt. boric acid, from 0.2 to 1.8% wt. a nonionic surfactant having a cloud point below about 25° C., and from 2.0 to 10% wt. a hydrotropic coupling agent consisting of caprylic acid in combination with a C9 or C 10 fatty acid in a ratio of about 6 to 1 and optionally up to about 0.2% to wt. a biocidal agent.

2. The aqueous solution of claim 1 wherein said hydrotropic coupling agent is caprylic acid in combination with capric acid.

3. The aqueous solution of claim 1 wherein said hydrotropic coupling agent is caprylic acid in combination with nonanoic acid.

4. The aqueous solution of claim 1 wherein said biocidal agent is sodium omadine.

* * * * *